US008909522B2

(12) United States Patent
Shperling et al.

(10) Patent No.: US 8,909,522 B2
(45) Date of Patent: Dec. 9, 2014

(54) VOICE ACTIVITY DETECTOR BASED UPON A DETECTED CHANGE IN ENERGY LEVELS BETWEEN SUB-FRAMES AND A METHOD OF OPERATION

(75) Inventors: Itzhak Shperling, Bnei Brak (IL); Sergey Bondarenko, Ramat-Gan (IL); Eitan Koren, Raanana (IL); Yosi Rahamim, Tel Aviv-Yaffo (IL); Tomer Yablonka, Meitar (IL)

(73) Assignee: Motorola Solutions, Inc., Schaumburg, IL (US)

( * ) Notice: Subject to any disclaimer, the term of this patent is extended or adjusted under 35 U.S.C. 154(b) by 1370 days.

(21) Appl. No.: 12/668,189

(22) PCT Filed: Jul. 8, 2008

(86) PCT No.: PCT/US2008/069394

§ 371 (c)(1),
(2), (4) Date: Nov. 9, 2010

(87) PCT Pub. No.: WO2009/009522

PCT Pub. Date: Jan. 15, 2009

(65) Prior Publication Data

US 2011/0066429 A1 Mar. 17, 2011

(30) Foreign Application Priority Data

Jul. 10, 2007 (GB) ..... 0713359.8

(51) Int. Cl.

| | |
|---|---|
| ***G10L 21/02*** | (2013.01) |
| ***G10L 11/02*** | (2006.01) |
| ***G10L 25/78*** | (2013.01) |
| *G10L 25/84* | (2013.01) |
| *G10L 21/0316* | (2013.01) |

(52) U.S. Cl.

CPC ..... *G10L 25/78* (2013.01); *G10L 21/02* (2013.01); *G10L 25/84* (2013.01); *G10L 21/0316* (2013.01)

USPC ..... 704/233; 704/236; 381/71.1

(58) Field of Classification Search

CPC ..... G10L 25/78; G10L 25/84; G10L 21/02; G10L 21/0316

USPC ..... 704/225–226, 233–234, 236; 381/71.1, 381/71.14

See application file for complete search history.

(56) References Cited

U.S. PATENT DOCUMENTS

| | | | | |
|---|---|---|---|---|
| 4,696,040 | A | 9/1987 | Doddington | |
| 5,884,257 | A * | 3/1999 | Maekawa et al. | 704/248 |

(Continued)

FOREIGN PATENT DOCUMENTS

| | | |
|---|---|---|
| EP | 0727769 A | 11/2001 |
| EP | 0979504 | 12/2003 |

(Continued)

OTHER PUBLICATIONS

Davis et al. "Statistical Voice Activity Detection Using Low-Variance Spectrum Estimation and an Adaptive Threshold." IEEE Transactions on Audio Speech, and Language Processing, vol. 14, No. 2, Mar. 2006, pp. 412-424.*

(Continued)

*Primary Examiner* — James Wozniak

(74) *Attorney, Agent, or Firm* — Anthony P. Curtis; Daniel R. Bestor

(57) ABSTRACT

A voice activity detector (100) includes a frame divider (201) for dividing frames of an input signal into consecutive sub-frames, an energy level estimator (202) for estimating an energy level of the input signal in each of the consecutive sub-frames, a noise eliminator (203) for analyzing the estimated energy levels of sets of the sub-frames to detect and eliminate from enhancement noise sub-frames and to indicate remaining sub-frames as speech sub-frames, and an energy level enhancer (205) for enhancing the estimated energy level for each of the indicated speech sub-frames by an amount which relates to a detected change of the estimated energy level for a current speech sub-frame relative to that for neighboring speech sub-frames.

19 Claims, 5 Drawing Sheets

(56) References Cited

U.S. PATENT DOCUMENTS

| | | | | |
|---|---|---|---|---|
| 6,098,040 | A | 8/2000 | Petroni | |
| 6,266,632 | B1 * | 7/2001 | Kato et al. | 704/219 |
| 6,269,331 | B1 * | 7/2001 | Alanara et al. | 704/205 |
| 6,314,396 | B1 | 11/2001 | Monkowski | |
| 6,381,570 | B2 | 4/2002 | Li | |
| 6,453,285 | B1 * | 9/2002 | Anderson et al. | 704/210 |
| 6,471,420 | B1 * | 10/2002 | Maekawa et al. | 704/250 |
| 6,629,070 | B1 | 9/2003 | Nagasaki | |
| 6,694,029 | B2 * | 2/2004 | Curtis et al. | 381/94.1 |
| 7,231,348 | B1 | 6/2007 | Gao | |
| 7,359,856 | B2 * | 4/2008 | Martin et al. | 704/226 |
| 8,121,835 | B2 * | 2/2012 | Archibald | 704/225 |
| 2001/0014857 | A1 | 8/2001 | Wang | |
| 2002/0103636 | A1 * | 8/2002 | Tucker et al. | 704/205 |
| 2002/0165711 | A1 | 11/2002 | Boland | |
| 2003/0032445 | A1 * | 2/2003 | Suwa | 455/552 |
| 2003/0053640 | A1 * | 3/2003 | Curtis et al. | 381/94.3 |
| 2005/0049877 | A1 * | 3/2005 | Agranat | 704/270 |
| 2005/0055207 | A1 * | 3/2005 | Fukada | 704/254 |
| 2005/0216260 | A1 * | 9/2005 | Ps et al. | 704/213 |
| 2005/0273328 | A1 | 12/2005 | Padhi | |
| 2006/0149536 | A1 * | 7/2006 | Li | 704/215 |
| 2006/0217976 | A1 | 9/2006 | Gao | |
| 2006/0224381 | A1 * | 10/2006 | Makinen | 704/223 |
| 2006/0271363 | A1 * | 11/2006 | Murashima | 704/233 |
| 2007/0185709 | A1 * | 8/2007 | Oh et al. | 704/208 |
| 2007/0271102 | A1 * | 11/2007 | Morii | 704/268 |
| 2008/0033723 | A1 * | 2/2008 | Jang et al. | 704/254 |
| 2008/0235011 | A1 * | 9/2008 | Archibald | 704/225 |

FOREIGN PATENT DOCUMENTS

| | | |
|---|---|---|
| WO | WO03063138 | 7/2003 |
| WO | WO2004075167 | 9/2004 |
| WO | WO2007041789 A1 | 4/2007 |

OTHER PUBLICATIONS

Sangwan, Abhijeet, et al. "VAD techniques for real-time speech transmission on the Internet." High Speed Networks and Multimedia Communications 5th IEEE International Conference on. IEEE, 2002, pp. 1-5.*

PCT Search Report Dated Sep. 18, 2008.

GB Search Report Dated Aug. 20, 2007.

PCT Preliminary Report on Patentability Dated Jan. 21, 2010.

* cited by examiner

VOICE ACTIVITY DETECTOR BASED UPON A DETECTED CHANGE IN ENERGY LEVELS BETWEEN SUB-FRAMES AND A METHOD OF OPERATION

TECHNICAL FIELD

The invention relates generally to a voice activity detector and a method of operation of the detector. More particularly, the invention relates to a voice activity detector employing signal energy analysis.

BACKGROUND

A voice activity detector (VAD) is a device that analyzes an input electrical signal representing audio information to determine whether or not speech is present. Usually, a VAD delivers an output signal that takes one of two possible values, respectively indicating that speech is detected to be present or speech is detected not to be present. In general, the value of the output signal will change with time according to whether or not speech is detected to be present in each frame of the analyzed signal.

A VAD is often incorporated in a speech communication device such as a fixed or mobile telephone, a radio communication unit or a like device. Use of a VAD is an important enabling technology for a variety of speech based applications such as speech recognition, speech encoding, speech compression and hands free telephony. The primary function of a VAD is to provide an ongoing indication of speech presence as well to identify the beginning and end of each segment of speech, e.g. separately uttered words or syllables. Devices such as automatic gain controllers employ a VAD to detect when they should operate in a speech present mode.

While VADs operate quite effectively in a relatively quiet environment, e.g. a conference room, they tend to be less accurate in noisy environments such as in road vehicles and, in consequence, they may generate detection errors. These detection errors include 'false alarms' which produce a signal indicating speech when none is present and 'mis-detects' which do not produce a signal to indicate speech when speech is present in noise.

There are many known algorithms employed in VADs to detect speech. Each of the known algorithms has advantages and disadvantages. In consequence, some VADs may tend to produce false alarms and others may tend to produce mis-detects. Some VADs may tend to produce both false alarms and mis-detects in noisy environments.

Many of the known VAD algorithms have an operational relationship to a particular speech codec and are adapted to operate in combination with the particular speech codec. This leads to difficulty and expense needed to modify the VAD when the speech codec has to be modified or upgraded.

A common feature of many VADs is that they utilize an adaptive noise threshold based on an estimation of absolute signal level. The absolute signal level can vary rapidly. As a result, a significant problem occurs when there is a transition in the form of a relatively steep increase in noise level. The noise threshold tracking may fail even if speech is absent. In this case, the VAD may interpret the steep increase in noise level as an onset of speech. One known way to alleviate the effect of such a transition is to measure the short-term power stationarity (extent of being stationary) of the input signal over a long enough test interval. This approach requires a period of time to detect the noise transition from one level to another plus the time interval required to apply the stationarity test, typically a total delay period of from about one to about three seconds.

In addition, the power stationarity test known in the art does not address the problem of noise level increases which occur during and between closely spaced speech utterances unless there are relatively long gaps between the utterances (longer than the test interval) and the noise level is stationary within those gaps.

In another known method which is a development of the power stationarity test, the lower envelope or minimum of the signal energy is tracked so that an adaptive noise threshold can be properly updated to a new level at the end of a speech utterance. However, in practice this method is likely to require a longer delay than the conventional power stationarity test. The reason is that the rate of increase (slope) of the lower envelope of the signal energy has to be transformed to match, on average, the expected increase of a speech signal.

Some known VADs may mistakenly classify strong radio noise in an initial period of typically 1.5 to 2 seconds as speech, or speech and noise intermittently, by producing a VAD decision every frame, e.g. typically every 10 milliseconds (msec), within the initial period. Where the VAD is coupled to control a radio transmitter of a first terminal, the erroneous speech detection by the VAD can trigger an erroneous radio transmission by the first terminal. Where the radio signal transmitted erroneously by the first terminal is received by a second terminal which is also coupled to a VAD, a similar effect can occur at the second terminal causing a further erroneous radio signal to be sent back to the first terminal. An infinite loop of erroneous commands and radio transmissions can be created in this way. The radio transmissions contain only noise which users of the first and second terminals may find to be very unsatisfactory. Only after the initial period of typically 1.5 to 2 seconds has elapsed, does the VAD coupled to the first terminal become stabilized to provide a correct decision of noise, thereby allowing the loop of erroneous commands and transmissions to be cut. The initial period required for stabilization in known VADs when strong noise is detected is considered to be too long.

Thus, there exists a need for a VAD and method of operation which addresses at least some of the shortcomings of known VADs and methods.

BRIEF DESCRIPTION OF THE ACCOMPANYING DRAWINGS

The accompanying drawings, in which like reference numerals refer to identical or functionally similar elements throughout the separate drawings are, together with the detailed description later, incorporated in and form part of the specification and serve to further illustrate various embodiments of the claimed invention, and to explain various principles and advantages of those embodiments. In the accompanying drawings:

Figure 1:
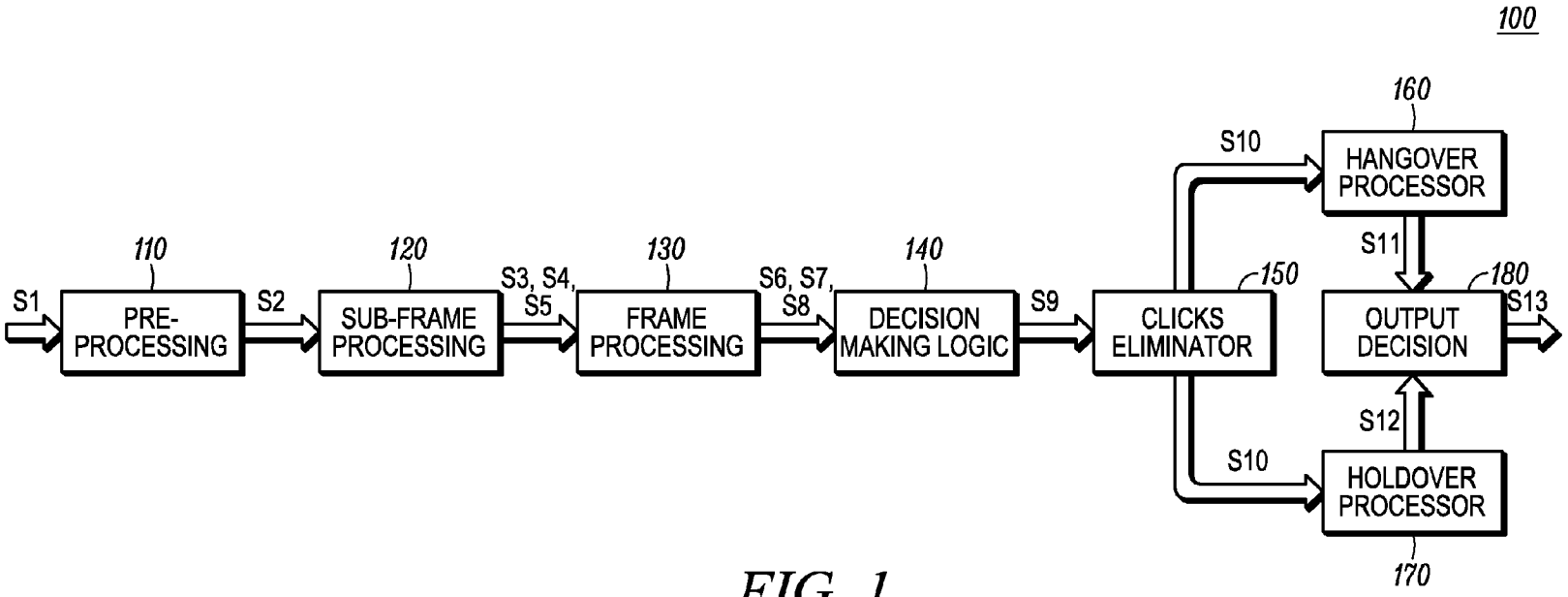
FIG. 1 is a block schematic diagram of a VAD in accordance with embodiments of the present invention.

Skilled artisans will appreciate that elements in the drawings are illustrated for simplicity and clarity and have not necessarily been drawn to scale. For example, the dimensions of some of the elements in the drawings may be exaggerated relative to other elements to help to improve understanding of various embodiments. In addition, the description and drawings do not necessarily require the order illustrated. Apparatus and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

DETAILED DESCRIPTION

Generally speaking, pursuant to the various embodiments of the invention to be described, an improved VAD and a method of its operation are provided. By use of the VAD embodying the invention, the initial period required for the VAD to stabilize and to make a correct initial VAD decision when strong noise is present may be significantly reduced, for example from typically 1.5 to 2 seconds as required in the prior art to typically about 250 milliseconds (msec) or less.

An additional benefit which may be obtained by use of the VAD embodying the invention is the elimination of strong short interfering impulses, known as 'clicks', e.g. produced by receiver circuitry switching.

A further benefit which may be obtained by use of the VAD embodying the invention is a reduction in the computational complexity and memory capacity required to implement operation of the VAD compared with known VADs, particularly VADs which are well established in use.

The VAD embodying the invention employs a method of analysis of an input signal which can be fast, yet can still provide detection of speech accurately under different signal input and noise conditions. The VAD can perform well for a wide range of signal energy input levels and background noise environments as well as for different rates of change of the energy level of the input signal. The VAD provides a very good reliability of prediction of whether or not an analyzed frame of an input signal representing audio information contains or is part of a speech segment. Where the VAD is employed to control a discontinuous transmitter, a transmission bandwidth saving, as well as a transmission energy saving, can beneficially be achieved since the VAD allows a reduction of the time required for signal analysis by the VAD to be obtained.

Furthermore, operation of the VAD embodying the invention in conjunction with a speech codec does not depend on any particular codec configuration.

Those skilled in the art will appreciate that the above recognized advantages and other advantages described herein in relation to VADs embodying the invention and methods of operation of such VADs are merely illustrative and are not meant to be taken as a complete rendering of all of the advantages of the various embodiments of the invention.

Referring now to the accompanying drawings, an illustrative VAD 100 embodying the invention is shown in FIG. 1. The VAD 100 comprises a number of functional blocks which may be considered as components of the VAD 100 or may alternatively be considered as method steps in a method of signal processing within the VAD 100. The functions of these blocks, and of the blocks and sub-blocks to be described which make up these blocks, may be implemented in the form of at least one programmed processor such as a digital signal processor (DSP).

An input signal S1 is applied in the VAD 100 shown in FIG. 1 to a pre-processing block 110. The input signal S1 is an analog electrical signal representing audio information which has been obtained from an audio-to-electrical transducer (not shown) such as a microphone and filtered by a low pass filter (not shown), e.g. having a pass band at frequencies below a suitable threshold, e.g. about 4 kHz, representing an upper end of the speech spectrum. The input signal S1 is to be analyzed by the VAD 100 to detect the presence of each active segment of the signal which represents speech. The pre-processing block 110 provides preliminary processing of the signal S1 and produces an output signal S2. The output signal S2 is delivered as an input signal to a sub-frame processing block 120. An illustrative arrangement providing a suitable example of the sub-frame processing block 120 is described later with reference to FIG. 2. The sub-frame processing block 120 processes the input signal S2 and produces output signals S3, S4 and S5 which are delivered as input signals to a frame processing block 130. An illustrative arrangement providing a suitable example of the frame processing block 130 is described later with reference to FIG. 3. The frame processing block 130 processes the signals S3, S4 and S5 to produce output signals S6, S7 and S8 which are delivered to a decision making logic block 140. An illustrative arrangement which is a suitable example of the decision making logic block 140 is described later. The decision making logic block 140 processes the signals S6, S7 and S8 to produce an output signal S9 which is delivered to a clicks eliminator block 150. The clicks eliminator block 150 processes the signal S9 to produce an output signal S10 which is delivered to a hangover processor block 160 and also to a holdover processor block 170. The hangover processor block 160 and the holdover processor block 170 process the signal S10 to produce respectively output signals S11 and S12 which are applied as input signals to an output decision block 180. The output decision block 180 uses the signals S11 and S12 to produce an output signal S13.

Operation of the functional blocks of the VAD 100 shown in FIG. 1 will now be described in more detail.

In the pre-processing block 110, the input signal S1 is sampled in a known manner at a suitable sampling rate, e.g. between about 5 kilosamples and about 10 kilosamples per second. The sampled signal is divided into consecutive frames of equal length (duration in time) in a known manner in the block 110. Each of the frames may for example have a typical length of from about 5 msec to about 50 msec, e.g. about 10 msec. The pre-processing block 110 may also apply known signal filtering and scaling functions. The filtering may comprise filtering by a high pass filter which filters out noise having a frequency below a suitable frequency threshold, e.g. about 300 Hz, which represents the lower end of the speech spectrum. Signal scaling comprises dividing the amplitude of the input signal S1 by a scaling factor, e.g. two, in order to suit a fixed-point digital signal processing implementation by reducing the possibility of overflows in such an implementation.

Figure 2:
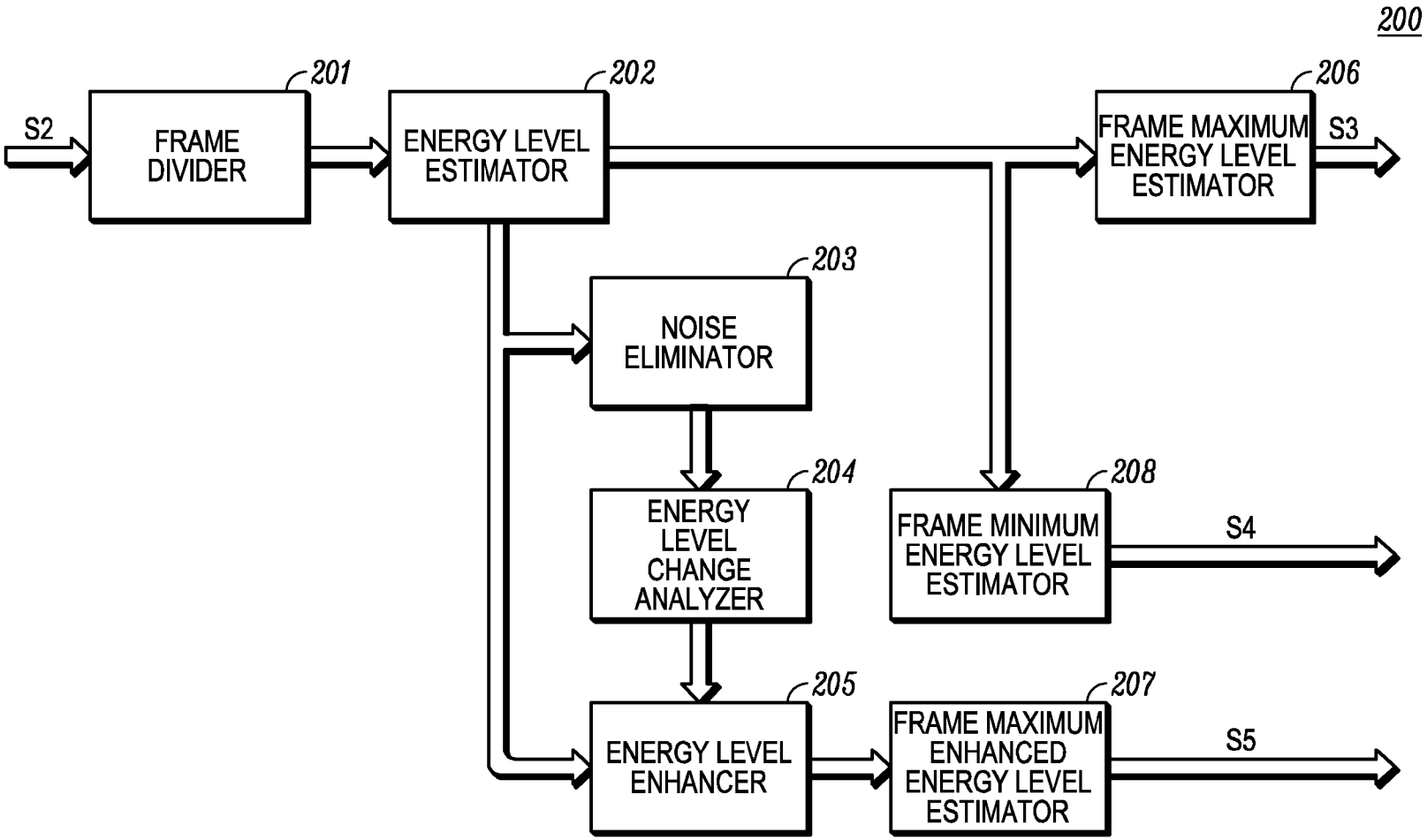
FIG. 2 is a block schematic diagram of an arrangement which is an illustrative example of a sub-frame processing block of the VAD of FIG. 1.

An arrangement 200 which provides an illustrative example of the sub-frame processing block 120 is shown in FIG. 2. The input signal S2 delivered from the pre-processing block 110 shown in FIG. 1 is applied in the arrangement 200 to a frame divider block 201 in which each frame of the signal S2 is divided into consecutive sub-frames of equal length, e.g. into four such sub-frames per frame, e.g. each sub-frame having a length of not greater than about 2.5 msec. Such a sub-frame length is chosen so that it will include as a minimum at least one voice pitch period of any speech segment present. Voice pitch periods range typically from about 2.5 msec to about 15 msec.

The energy level of each sub-frame produced by the frame divider block 201 of the arrangement 200 is estimated by an energy level estimator block 202. The estimation may be performed by the block 202 by use of a standard energy estimation algorithm such as one which calculates the result of the following summation equation using discrete signal samples contained within each of the consecutive sub-frames:

$$e_s = \frac{1}{L}\sum_{l=0}^{L-1} x^2(l)$$

where $e_s$ is the sub-frame energy level to be estimated, x(l) is the l-th signal sample in a given sub-frame and L is the total number of samples contained within each sub-frame. As an illustrative example, there are L=20 samples in a sub-frame having a length of 2.5 msec when the sampling rate is 8 kHz.

An output signal produced by the energy level estimator block 202, which comprises a sequence of energy level values for consecutive signal sub-frames, is applied to a noise eliminator block 203 and also to an energy level enhancer block 205.

The noise eliminator block 203 analyzes the sub-frame energy level values of the output signal produced by the energy level estimator block 202 to detect if the signal component in each of the sub-frames is clearly noise, particularly interference noise, rather than speech.

Each sub-frame or frame considered in an analysis or processing by a functional block of the VAD 100 is referred to herein as the 'current' sub-frame or frame as appropriate. Thus each sub-frame considered in turn by the block 203 in its analysis is referred to herein as the 'current' sub-frame. Where the block 203 detects that a current sub-frame contains speech, the block 203 provides the energy level value of that sub-frame in an output signal delivered to an energy level change analyzer block 204 thereby indicating that speech is present in that sub-frame. Where the block 203 detects that a current sub-frame contains noise, the block 203 provides for that sub-frame an energy level value of zero, or a minimum background energy level value, thereby eliminating the noise represented by the energy level value of the sub-frame from enhancement by the block 205.

The block 203 may determine whether each current sub-frame contains speech or noise in the following ways. The block 203 may analyze the energy level values for a set of successive sub-frames each including the current sub-frame in a particular position of the set. For example, each set analyzed may include eight sub-frames at a time with the current sub-frame being the most recent sub-frame of the set. The sub-frames forming each set analyzed may move along one sub-frame at a time from one set to the next. The energy level values in each set of the sub-frames are analyzed by the block 203 to determine if there is a consistency in such values, that is an approximately constant envelope of such values. The block 203 may also detect, by analysis of energy level values of each set of the sub-frames, noise having a characteristic periodicity (frequency), such as electrical noise having a periodicity of 50 Hz or 60 Hz. The block 203 carries out this detection by analyzing the energy level values in each set of the sub-frames to detect noise showing an increase in energy level at the characteristic periodicity.

The block 203 may also analyze changes in the energy level value from one sub-frame to the next, where one of the sub-frames is the current sub-frame, to detect rapid energy level changes in the form of noise 'clicks', e.g. due to receiver radio switching.

The energy level change analyzer block 204 further analyzes the energy level values for sub-frames which are indicated by the block 203 to contain speech by their presence in the output signal produced by the block 203 and received as an input signal by the block 204. The block 204 analyzes sets of consecutive sub-frames of the input signal applied to it, e.g. sets of three adjacent sub-frames obtained by moving the set of sub-frames by one sub-frame at a time. The current sub-frame represented by the set may be considered to be at the middle sub-frame position of each set. The block 204 determines how the energy value is changing across the analyzed set of sub-frames. The block 204 produces an output signal which comprises for each current sub-frame represented by the analyzed set a value of an enhancement factor giving a quantitative indication of how the sub-frame energy value is changing across the set of analyzed sub-frames. The enhancement factor indicated for each current sub-frame is a measure for the current sub-frame of the shape of the envelope of the energy level value in the analyzed set of sub-frames represented by the current sub-frame, and of the rate of change of the sub-frame energy level value within the analyzed set.

The enhancement factor value is provided only for sub-frames indicated by the block 203 to be speech sub-frames. There is an enhancement factor of zero for sub-frames which were determined by the block 203 to be noise. The output signal produced by the block 204 including the enhancement factor for each sub-frame is delivered as an input signal to the energy level enhancer block 205 in addition to the input from the energy level estimator block 202.

The energy level enhancer block 205 uses the enhancement factor value for each current sub-frame indicated to be a speech sub-frame in the input signal received from the block 204 to enhance the energy level value of the corresponding current sub-frame of the input signal received by the block 205 from the energy level estimator block 202. The block 205 adds the enhancement factor for each current sub-frame to the energy level value for the corresponding current sub-frame of the input signal received from the block 202 to enhance the energy level value. The block 205 thereby produces an output signal in which a variable enhancement has been applied to the estimated sub-frame energy level values for sub-frames detected and indicated by the block 203 to be speech sub-frames. The purpose of the enhancement applied by the block 205 is to provide an enhancement of sub-frames in which speech is detected and indicated (by the block 203) to be present, the enhancement being greater where the energy level of the speech is detected and indicated (by the block 204) to be rising at the beginning of a speech segment (word or syllable) or falling at the end of a speech segment.

The energy level change analysis and energy level enhancement operations applied co-operatively by the blocks 204 and 205 may be further explained as follows.

It may be observed from analyzing the composition of speech that there are different time-variant features of speech compared with background noise. In particular, consonants and fricatives (consonants produced by partial air stream occlusions, e.g. f or z) before and after vowels have low energy in the higher frequency part of the speech frequency spectrum, e.g. between the middle of the speech frequency spectrum and the high frequency end of the speech frequency spectrum, whilst the vowels have high energy in the low frequency part of the speech frequency spectrum, e.g. between the middle of the speech frequency spectrum and the low frequency end of the speech frequency spectrum. The speech energy enhancement operation carried out by the energy enhancer block 205 is based upon this observation. Thus, in order to emphasize the beginning and ending of speech segments or utterances, the amount of the speech energy enhancement applied is related to the local shape of the envelope of the energy level value and the local extent of change of the energy level value from one current speech sub-frame to the next, the extent of change being greater at the beginning and ending of speech segments or utterances.

The block 204 may conveniently determine the local shape of the envelope of the energy level values for each analyzed set of the speech sub-frames by determining that the local shape is a selected one of a pre-defined set of different possible shapes depending on how the energy level value changes from sub-frame to sub-frame within the analyzed set. For example, the selected shape may be one of a set of possible shapes, e.g. eight possible shapes, depending on the sign of changes of the energy level value between adjacent sub-frames of the analyzed set.

The enhancement factor calculated by the block 204 and employed for enhancement by the block 205 for each current speech sub-frame may have a pre-defined relationship to the selected shape, so that the enhancement factor is greater where the selected shape indicates the beginning or ending of a speech segment or utterance. The enhancement factor calculated by the block 204 for each current speech sub-frame may further relate to an extent of change of the estimated energy level value across the set of analyzed sub-frames and between adjacent sub-frames of the set for the selected envelope shape, so that the enhancement factor is greater where the extent of change is greater, again indicating the beginning or ending of a speech segment or utterance.

A detailed illustrative example of operation of each of the blocks 203 to 205 will now be described as follows.

In the detailed example of operation of the noise eliminator block 203, the energy level value for each sub-frame is compared with a plurality of predictive relative thresholds that are selected to analyze signal energy consistency between sub-frames to differentiate between an active speech signal and noise. The thresholds are defined by use of a series of auxiliary Boolean (logic) variables which are employed in signal processing by the block 203 to capture familiar possibilities of interference noise present in the input signal S2, such as indicated by: (i) an approximately constant energy level envelope with an increase in energy level having a known periodicity, e.g. as produced by 50 Hz or 60 Hz electrical noise (known also as 'hum'); or (ii) a rapid increase in energy level such as produced by radio switching, known in the art as 'clicks'. The block 203 detects the characteristic features of such familiar interference noise. The auxiliary Boolean variables employed may be defined as the set of the variables $I_f$, having possible values of 0 and 1, where the subscript f refers to a 'flat' envelope. $I_f$ is given the value of '1' if one of the following empirically derived conditions is satisfied:

$$I_f(n)=[(e_s(n)\geq 0.5\cdot e_s(n-7))\ \&\ (0.5\cdot e_s(n)\leq e_s(n-7))]$$

or $$[(e_s(n)\geq 0.5\cdot e_s(n-8))\ \&\ (0.5\cdot e_s(n)\leq e_s(n-8))],$$

where n denotes the sub-frame number, $e_s(n)$ denotes the energy level value for the sub-frame number n and & denotes a Boolean AND operation. Otherwise, $I_f$ is given the value of zero.

Thus, in the detailed example of operation of the block 203, the value of the variable $I_f$ is determined for each sub-frame numbered n for each analyzed set of the sub-frames. The conditions specified above which give $I_f(n)=1$ are designed to detect noise having a periodicity of about 7 or 8 sub-frames, corresponding to frequencies of 60 Hz or 50 Hz respectively, due to electrical interference. In the case of a presence of strong constant envelope periodic interference noise, the sub-frame energy level value $e_s(n)$ is replaced in the detailed example of operation of the block 203 by a sample median $e_{s.m.}(n)$ defined as:

$$e_{s.m.}(n)=\max(e_s(n-3),e_s(n-4))$$

in order that noise having a frequency of 60 Hz or 50 Hz is suppressed but speech having a higher frequency is not suppressed.

The sub-frame energy level value to be obtained after the elimination of interference noise giving a 'flat' envelope and an energy level increase having a periodicity or frequency of about 60 Hz or 50 Hz may be defined by a modified term $e_{sf}(n)$, whose value is as given by the following conditions:

$$e_{sf}(n)=\begin{cases} e_s(n) & \text{for } I_f(n)=0, \\ e_{s.m.}(n) & \text{for } I_f(n)=1 \end{cases}$$

where $e_{s.m.}(n)$ is the sample median defined earlier.

Thus, in the detailed example of operation, the block 203 establishes for each current sub-frame one of the values of $e_{sf}(n)$ defined above according to whether $I_f(n)$ has a value of '1' or '0'.

It is to be noted that $e_{sf}(n)$ is not zero when $I_f(n)$ is zero because $e_{sf}(n)$ may still contain speech or background noise in addition to any strong interference noise that is to be subtracted from it.

Detection and avoidance of enhancement of clicks is carried out in the detailed example of the operation of the block 203 by signal processing using a Boolean variable $I_c(n)$, where the subscript 'c' indicates 'clicks'. This Boolean variable has a value of '1' only where a very steep energy level change occurs within a set of analyzed sub-frames including the current sub-frame, e.g. the last four sub-frames including the current sub-frame. The Boolean variable $I_c(n)$ has a value of '0' otherwise. The Boolean variable $I_c(n)$ may have a value of '1' for example when one of the following illustrative conditions applies:

$$I_c(n)=[(e_{sf}(n)\geq 512\cdot e_{min}(n))\ \text{or}\ (e_{sf}(n)\geq 128\cdot e_{sf}(n-1))]$$

where $e_{sf}(n)$ and n are as defined above and $e_{min}(n)$ is the minimum value of sub-frame energy level from the last four successive sub-frames including the current sub-frame numbered n. The multipliers 128 and 512 are selected factors which are of the form $2^m$, where m is an integer, to reduce the computational load in an implementation to provide suitable digital signal processing in the block 203. The energy level value of each current sub-frame is modified in the detailed example of operation of the block 203 to suppress non-speech sub-frame energy level values which are due to 'clicks' by use of a modified sub-frame energy value, $e_{sfc}(n)$, defined by the following conditions:

$$e_{sfc}(n) = \begin{cases} e_{sf}(n), & \text{for } I_c(n) = 0, \\ e_{min}(n), & \text{for } I_c(n) = 1 \end{cases}$$

In other words, if a click is detected, it is eliminated by replacing its sub-frame energy level value by the background noise sub-frame energy level value: $e_{sfc}(n)$ is set to $e_{min}(n)$ for a current sub-frame numbered n when the Boolean variable $I_c(n)$ has been given the value '1' by the block 203 for that sub-frame.

For the detailed example of operation of the energy level change analyzer block 204, two energy level differences δ(n) and Δ(n) are obtained from analysis of the energy level values for a set of three sub-frames having the current sub-frame at the middle of the analyzed set. The energy level differences δ(n) and Δ(n) are defined by the following equations:

$$\delta(n)=e_{sfc}(n)-e_{sfc}(n-1)$$

and $$\Delta(n)=e_{sfc}(n+1)-e_{sfc}(n-1)=\delta(n+1)+\delta(n)$$

The differences δ(n) and δ(n) are found simultaneously by the block 204 using the modified energy level values $e_{sef}$ indicated in the input signal received from the block 203. The differences δ(n) and Δ(n) are found for the current sub-frame and the sub-frames immediately before and after the current sub-frame. The signs and magnitudes of the differences δ(n) and Δ(n) are employed by the block 204 to find the value of each of eight mutually exclusive Boolean variables, $I_1(n)$ to $I_8(n)$. Each of the variables $I_1(n)$ to $I_8(n)$ has a value of '1' if one of the following eight conditions applies and a value of '0' otherwise:

$$I_1(n)=(|\Delta(n)|>|\delta(n)|)\ \&\ (\text{sign}[\Delta(n)]<0)\ \&\ (\text{sign}[\delta(n)]<0)$$

$$I_2(n)=(|\Delta(n)|>|\delta(n)|)\ \&\ (\text{sign}[\Delta(n)]>0)\ \&\ (\text{sign}[\delta(n)]>0)$$

$$I_3(n)=(|\Delta(n)|<|\delta(n)|)\ \&\ (\text{sign}[\Delta(n)]<0)\ \&\ (\text{sign}[\delta(n)]<0)$$

$$I_4(n)=(|\Delta(n)|<|\delta(n)|)\ \&\ (\text{sign}[\Delta(n)]>0)\ \&\ (\text{sign}[\delta(n)]>0)$$

$$I_5(n)=(|\Delta(n)|>|\delta(n)|)\ \&\ (\text{sign}[\Delta(n)]>0)\ \&\ (\text{sign}[\delta(n)]<0)$$

$$I_6(n)=(|\Delta(n)|>|\delta(n)|)\ \&\ (\text{sign}[\Delta(n)]<0)\ \&\ (\text{sign}[\delta(n)]>0)$$

$$I_7(n)=(|\Delta(n)|<|\delta(n)|)\ \&\ (\text{sign}[\Delta(n)]>0)\ \&\ (\text{sign}[\delta(n)]<0)$$

$$I_8(n)=(|\Delta(n)|<|\delta(n)|)\ \&\ (\text{sign}[\Delta(n)]<0)\ \&\ (\text{sign}[\delta(n)]>0)$$

It should be noted that the possibilities defined by these eight conditions constitute a complete set given by the following summation:

$$\sum_{k=1}^{8} I_k(n) = 1$$

Thus, the Boolean variables $I_k(n)$, k=1, . . . 8, form the complete set of shapes given by possible changes in sign and magnitude of sub-frame energy level values between adjacent sub-frames for each analyzed set of three adjacent sub-frames, where each set moves one sub-frame at a time so that each of the consecutive sub-frames in turn forms a current sub-frame at the middle of its set. In other words, each of the variables $I_1(n)$ to $I_S(n)$ represents a different local shape, in a set of eight possible shapes, of the envelope of the energy level value. Each of these variables has the value '1' when the shape represented by the variable is found by the block 204 to be present. Otherwise, each of these variables has the value '0'.

In the detailed example of operation, the block 204 also uses the differences δ(n) and Δ(n) defined above to find values of an enhancement factor $g_k(n)$, where k is an integer in the series k=1, 2, . . . 8, which has the same value as k in the expression $I_k(n)$. The enhancement factor $g_k(n)$ has values defined by the following pre-determined relationships obtained empirically:

$$g_1(n)=g_2(n)=2\cdot|\Delta(n)|+|\delta(n)$$

$$g_3(n)=g_4(n)=|\Delta(n)|$$

$$g_5(n)=_6(n)=|\Delta(n)|-|\delta(n)|$$

$$g_7(n)=g_8(n)=0$$

In the detailed example of operation, the block 204 analyzes the sub-frames of each set of three sub-frames and produces for each current sub-frame of the set an indication of which one of the variables $I_1(n)$ to $I_s(n)$, that is which $I_k(n)$, has the value '1' and calculates a corresponding value of $g_k(n)$ for the current sub-frame using the value of k giving $I_k(n)=1$. The block 204 produces an output signal indicating for each current sub-frame the value of $g_k(n)$ so calculated.

In the detailed example of operation, the block 205 receives as an input signal the output signal produced by the block 204 and, for each indicated speech sub-frame of the input signal, uses the value of $g_k(n)$ indicated to produce an enhanced sub-frame energy value, $E_s(n-1)$. The block 205 carries out this procedure by adding to the value of the sub-frame energy level $e_{sfc}(n-1)$ indicated in the signal delivered from the energy level estimator block 202, an enhancement defined by the following equation:

$$E_s(n-1) = e_{sfc}(n-1) + \left(\sum_{k=1}^{8} g_k(n)\cdot I_k(n)\right)$$

As noted above, only one of the eight Boolean variables $I_k(n)$ has the value '1' for each speech sub-frame and consequently only that one variable together with the corresponding enhancement factor $g_k(n)$ having the same index k as that one variable produces a finite component in the summation expression on the right hand side of the above equation defining $E_s(n-1)$. Thus, the block 205 produces an output signal in which the energy level value for each indicated speech sub-frame has been enhanced according to the above equation defining $E_S(n-1)$.

The output signal produced by the energy level estimator block 202 is also delivered as an input signal to a frame maximum energy level estimator block 206 and to a frame minimum energy level estimator block 208. The output signal produced by the energy level enhancer block 205 is applied as an input signal to a frame maximum enhanced energy level estimator block 207.

The frame maximum energy level estimator block 206 uses the sub-frame energy values in the input signal from the block 202 to determine for each frame a maximum value of the energy level of the signal S2 (FIG. 1) and to produce an output signal indicating the maximum value for each frame. Similarly, the frame maximum enhanced energy level estimator block 207 uses the enhanced sub-frame energy values in the input signal from the block 205 to determine for each frame a maximum of the enhanced energy level value and to produce an output signal indicating the maximum enhanced energy level value for each frame. Similarly, the frame minimum energy level estimator block 208 uses the sub-frame energy level values in the signal from the block 202 to determine a minimum value for each frame of the signal S2 (FIG. 1).

The minimum value determined by the block 208 may be a minimum value determined separately for each frame. Alternatively, or in addition, the minimum value may be a minimum value averaged over several consecutive frames over a suitable period, e.g. 25 frames prior to and including the current frame over a period of 250 msec. For example, the minimum value for each of the several frames may be determined separately and then the overall average minimum value for the several frames may be determined from the several individual minima. The minimum frame energy value represents the background noise energy level, so the averaging procedure has the effect of smoothing the minimum energy level value employed in subsequent maximum-to-minimum ratio calculations carried out in the frame processing block 130, e.g. in a manner to be described later with reference to FIG. 3.

Thus, the frame minimum energy level estimator block 208 produces an output signal indicating the minimum energy level value (which may be a smoothed minimum energy level value) to be employed for each frame.

The blocks 206, 208 and 207 respectively produce as output signals the signals S3, S4 and S5 (indicated also in FIG. 1).

Figure 3:
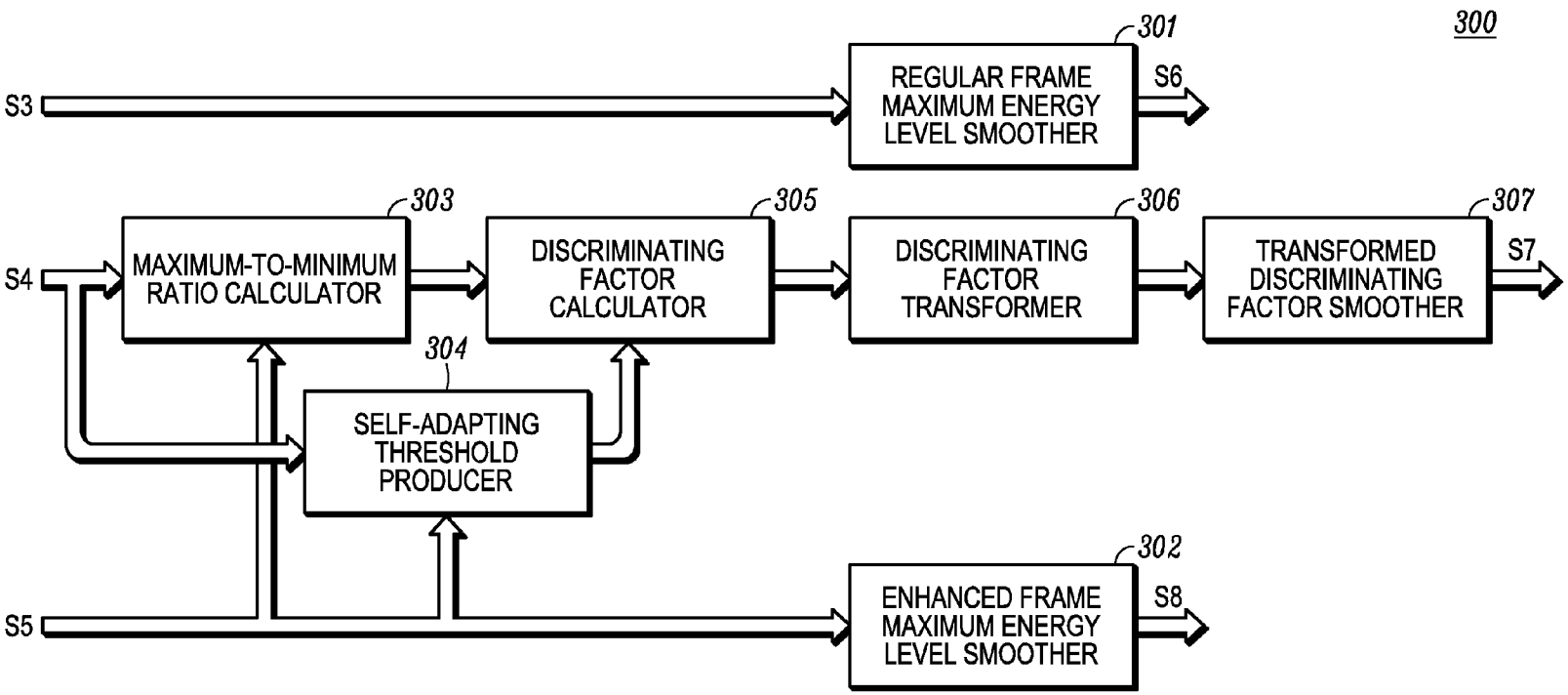
FIG. 3 is a block schematic diagram of an arrangement which is an illustrative example of a frame processing block of the VAD of FIG. 1.

An arrangement 300 which provides an illustrative example of the frame processing block 130 (FIG. 1) is shown in FIG. 3. The signal S3 produced by the frame maximum energy level estimator block 206 (FIG. 2) is applied in the arrangement 300 to a regular (unenhanced) frame maximum energy level smoother block 301. The block 301 produces a smoothing over a set of several frames, e.g. typically 25 frames prior to and including the current frame over a period of 250 msec, of the maximum of the regular energy level value for each frame indicated by the signal S3. For example, the maximum value of the regular frame energy level for each frame of a set of several frames may be determined and then the average maximum value for the several frames may be determined from the several individual maxima to give the smoothed maximum value. The set of frames considered may be shifted by one frame at a time to form a smoothed maximum applicable to each current frame. The block 301 produces accordingly as an output signal the signal S6 (also indicated in FIG. 1).

The signal S5 produced by the frame maximum enhanced energy level estimator block 207 (FIG. 2) is applied in the arrangement 300 to an enhanced frame maximum energy level smoother block 302. The block 302 produces a smoothing over several frames of the maximum enhanced energy level value for each frame, e.g. in a manner similar to the smoothing applied by the block 301. The block 302 produces accordingly as an output signal the signal S8 (also indicated in FIG. 1).

The signal S4 produced by the frame minimum energy level estimator block 208 (FIG. 2) is applied in the arrangement 300 as a first input signal to a maximum-to-minimum ratio calculator block 303. The signal S5 produced by the frame maximum enhanced energy level estimator block 207 is applied as a second input signal to the block 303. The signal S4 produced by the block 208 (FIG. 2) is also applied as a first input signal to a self-adapting threshold producer block 304. The signal S5 produced by the block 207 (FIG. 2) is also applied as a second input signal to the block 304.

The maximum-to-minimum ratio calculator block 303 calculates for each current frame, e.g. in a manner described later, a normalized ratio of the enhanced maximum energy level value to the minimum energy level value for each frame, as indicated respectively in the signals S5 and S4, and produces an output signal accordingly. The output signal is delivered as a first input signal to a discriminating factor calculator block 305.

The self-adapting threshold producer block 304 calculates for each current frame, e.g. in a manner to be described later, an adaptive threshold value to be employed in a calculation of a discriminating factor for each frame carried out by the block 305. The block 304 produces an output signal accordingly which is delivered as a second input signal to the block 305.

The discriminating factor calculator block 305 calculates for each current frame using the first and second input signals applied to it a value of a discriminating factor. This is obtained by subtracting from the value of the normalized maximum-to-minimum ratio for the current frame as calculated by the block 303 the value of the self-adapting threshold for the current frame as calculated by the block 304. The discriminating factor is a measure for each current frame of the extent to which signal exceeds noise in the current frame. The block 305 accordingly produces an output signal which is delivered as an input signal to a discriminating factor transformer block 306 which in turn processes the input signal and delivers a further signal to a transformed discriminating factor smoother block 307.

The block 306 produces a non-linear transformation of the signal delivered from the block 305 whereby the discriminating factor value for each current frame of the input signal is compared with a pre-determined threshold value of the discriminating factor and is enhanced to a pre-determined maximum or transformed value if the discriminating factor value of the input signal is equal to or greater than the threshold value. An example of this operation by the block 306 is described later. The block 307 produces a smoothing of the transformed discriminating factor value produced by the block 306 as indicated for each frame by the signal delivered to the block 307 from the block 306. The smoothing is carried out in order to retain relatively long speech fragments and to suppress relatively short non-speech fragments. For example, the smoothing may include determining an average value of the transformed discriminating factor value for each of a set of several frames. The average or smoothed value is then used as the discriminating factor value for a current frame represented by the set. The set of frames considered may be moved by one frame at a time so that the current frame of the set is correspondingly moved. The block 307 produces as an output signal the signal S7 (also indicated in FIG. 1).

A detailed illustrative example of operation of each of the blocks 303 to 306 will now be described as follows.

In the detailed example of operation of the block 303, the normalized maximum-to-minimum ratio calculated for energy level values in each frame may be indicated as the parameter R(n) and may be determined by the block 303 using the following relationships:

$$R(n) = K \cdot \frac{E_{max}(n)}{E_{max}(n) + N_{min}(n)} = K \frac{\frac{E_{max}(n)}{N_{min}(n)}}{\frac{E_{max}(n)}{N_{min}(n)} + 1} = K \frac{MMR(n)}{MMR(n) + 1} = K \frac{1}{1 + \frac{1}{MMR(n)}}$$

where n is the frame number, $E_{max}(n)$ is the maximum enhanced energy level value in frame number n, $N_{min}(n)$ is the minimum energy level value in frame number n, e.g. the average minimum energy level value of sub-frames obtained in the last smoothing period, e.g. of typically 250 msec. MMR is the ratio $E_{max}/N_{min}$·K is a constant scaling factor selected to give suitable resolution of the self-adapting threshold produced by the block 302. K is conveniently selected to be of the form $K=2^p$, where p is an exponent which is an integer number. The exponent p is chosen to be an integer number to simplify implementation for digital signal processing. The parameter R(n) may alternatively be written as being equal to K times 1/(1+r), where r is a ratio of the frame minimum energy level to the frame maximum energy level, i.e. r is the reciprocal of MMR.

The self-adapting threshold may be indicated as Th(n) and calculated by the block 302 using the following relationship:

$$Th(n) = Th_w(n, MMR) = K \cdot \frac{w \cdot N_{min}(n)}{w \cdot N_{min}(n) + E_{max}(n)} = K \cdot \frac{w}{w + \frac{E_{max}(n)}{N_{min}(n)}} = K \cdot \frac{1}{1 + \frac{MMR(n)}{w}}$$

where $w=2^i$ is a control parameter that can be set to adjust the self-adapting threshold for suitable VAD performance. The parameter w is conveniently a selectable constant of the form $w=2^1$, where i is an integer. The self-adapting threshold $Th_w$ may alternatively be written as being equal to K times $1/(1+r_1)$, where K is as defined above, and $r_1$ is the ratio MMR of the frame maximum energy level to the frame minimum energy level divided by the factor w.

The minimum value of the frame energy level, $N_{min}(n)$, is assumed to be non-zero (positive), since for $N_{min}(n)=0$, a decision of 'no speech' is taken for the whole frame.

Figure 4:
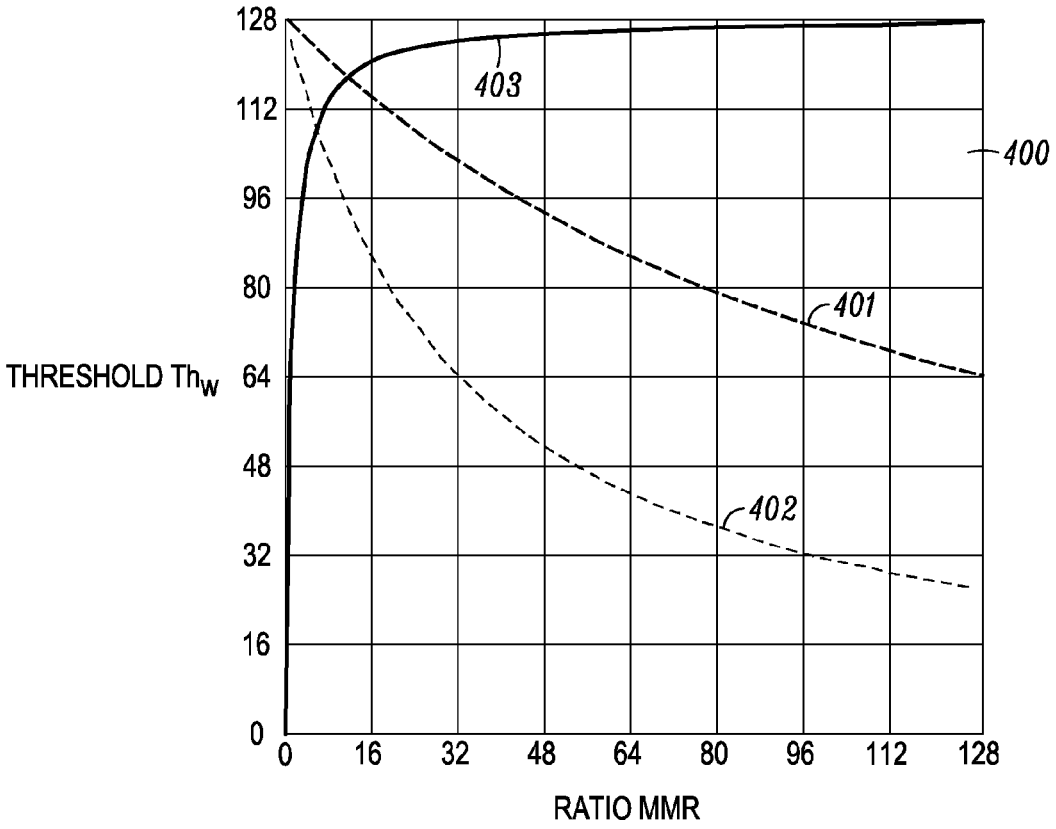
FIG. 4 is a graph of self-adapting threshold $Th_w$ plotted against frame energy maximum-to-minimum ratio (MMR) illustrating processing by one of the frame processing blocks in the arrangement of FIG. 3.

The self-adapting threshold $Th(n)=Th_w(n,MMR)$ is shown in FIG. 4, plotted in a graph 400 as a function of the maximum-to-minimum ratio MMR for two values of the control parameter w. A first curve 401 is a plot of the threshold $Th_w$ as a function of MMR for the example w=128. A second curve 402 is a plot of the threshold $Th_w$ as a function of MMR for the example w=32. The threshold $Th_w$ in each of the curves 401 and 402 is shown to be a monotonically decreasing function of the maximum-to-minimum ratio MMR defined above. A third curve 403 shown in FIG. 4 is a plot of the normalized maximum-to-minimum ratio R(n) referred to earlier. The curve 403 is shown as a monotonically increasing function of the maximum-to-minimum ratio MMR. The difference between the normalized maximum-to-minimum ratio R(n) indicated by the curve 403 and the self-adapting threshold $Th_w$=Th(n) indicated by either the curve 401 or the curve 402 is the discrimination factor referred to earlier. The discriminating factor may be expressed as DF(n) by the following relationship:

$$DF(n)=R(n)-Th(n)\geq 0$$

Figure 5:
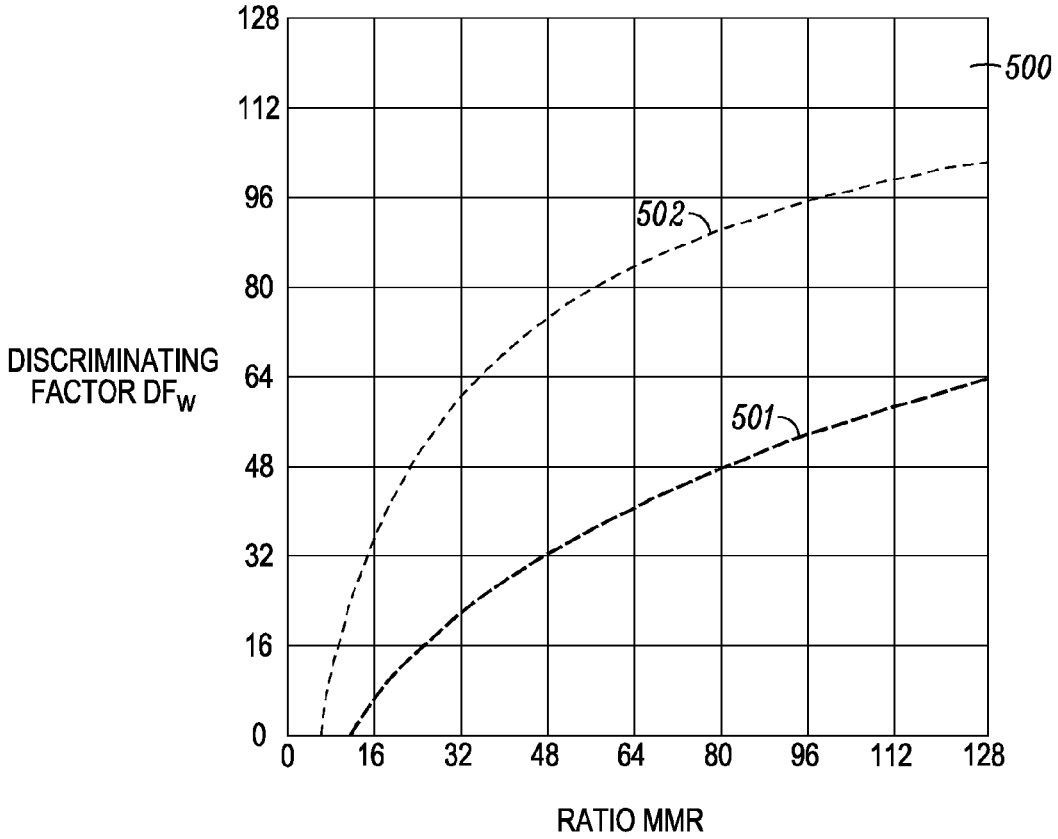
FIG. 5 is a graph of discriminating factor $DF_w$ plotted against frame energy maximum-to-minimum ratio (MMR) illustrating processing by another one of the frame processing blocks in the arrangement of FIG. 3.

The discriminating factor DF(n) may also be written as $DF_w(n, MMR)$. FIG. 5 shows a graph 500 of the discriminating factor $DF_w$ plotted as a function of the maximum-to-minimum ratio $MMR=E_{max}/N_{min}$. A first curve 501 is a plot of the discriminating factor $DF_w$ as a function of MMR for the example w=128. A second curve 502 is a plot of the discriminating factor $DF_w$ plotted as a function of MMR for the example w=32.

In the detailed example of operation, the blocks 306 and 307 operate in the following way. The discriminating factor transformer block 306 applies to the signal from the discriminating factor calculator block 305 a non-linear transformation according the following conditions:

$$DF(n) = \begin{cases} K, & DF(n) \geq DF_0 \\ DF(n), & DF(n) < DF_0 \end{cases}$$

where $DF_0$ is a limiting threshold. Thus, the non-linear transformation enhances signals that cross the limiting threshold $DF_0$. The limiting threshold $DF_0$ can be selected accordingly. For example, the following parameter values may be used in the transformation operation: $K=2^7=128$, w=64, $DF_0=64$. The block 306 accordingly produces an output signal which is applied as an input signal to the transformed discriminating factor smoother block 307. The block 307 performs the following calculation using the input signal which it receives from the block 306. The block 307 obtains for a window (set) of W frames, moving one frame at a time, where $W=2^m$ and m is a pre-selected integer, an average of the transformed values of DF(n) for each frame as indicated in the input signal from the block 306 to produce for each frame a smoothed output value.

Several stages of the transforming and the smoothing (averaging) operations applied together as a pair of operations by the block 306 and the block 307 may be applied iteratively for each frame. The purpose of such a procedure is to create an iterative enhancement of speech segments and of weak fricative endings of speech segments. The different iterative stages applied together by the blocks 306 and 307 may use: (i) different limiting thresholds $DF_i$, where i is the stage index number, and (ii) different values of the window size W. For example, five transforming and smoothing stages, each indicated by the index i, may be applied iteratively in which the window sizes $W_i$ and limiting thresholds $DF_i$, are respectively $W_1=32$, $DF_1=40$ for the first stage, $W_2=32$, $DF_2=32$ for the second stage, $W_3=16$, $DF_3=32$ for the third stage, $W_4=8$, $DF_4=24$ for the fourth stage, and $W_5=64$, $DF_5=64$ for the fifth stage.

The output signal S7 produced by the block 307 comprising the transformed, smoothed discriminating factor value $DF_s(n)$, is delivered as an input signal to the decision making logic block 140 shown in FIG. 1, together with the signals S6 and S8 produced by the blocks 301 and 302. The signals S6 and S8 may be considered to represent parameters $e_{smth}(n)$ and $E_{smtn}(n)$ respectively, which are the smoothed values for each frame of the regular and enhanced frame maximum energy level values referred to earlier. The decision making logic block 140 applies logical rules using the input signals applied to it to decide whether or not each current frame is speech or noise and to produce an output signal indicating the decision for each frame.

The block 140 may for example calculate for each frame of the input signal S7 from the block 307 a normalized variable weight W(n) which has a value given by the following expression:

$$W(n)=K-DF_s(n)\leq 1$$

The decision making logic block 140 may use the normalized variable decision weight W(n) and the parameters $e_{smth}(n)$ and $E_{smth}(n)$ of the signals S6 and S8, to produce a signal D(n) having for each frame the value '1' or the value '0' according to the following decision rule:

$$D(n)=\begin{cases}1, & \text{if } E_{smth}(n)>\mu_E\cdot W(n)\cdot e_{smth}(n) \text{ or } e_{smth}(n)>\mu_e\cdot W(n)\cdot E_{smth}(n)\\ 0, & \text{otherwise}\end{cases}$$

where $\mu_E$ and $\mu_e$ are correcting coefficients selected to match the operational dynamic ranges of the VAD 100. In an illustrative non-limiting example, $\mu_E=1/16$ and $\mu_e=1/64$. The above decision rule can also be written:

$$D(n)=\begin{cases}1, & \text{if } \frac{E_{smth}(n)}{e_{smth}(n)}>\mu_E\cdot W(n) \text{ or } \frac{e_{smth}(n)}{E_{smth}(n)}>\mu_e\cdot W(n)\\ 0, & \text{otherwise}\end{cases}$$

and also as:

$$D(n)=\begin{cases}1, & \text{if } \frac{E_{smth}(n)}{e_{smth}(n)}>\mu_E\cdot W(n) \text{ or } \frac{E_{smth}(n)}{e_{smth}(n)}<\frac{1}{\mu_e\cdot W(n)}\\ 0, & \text{otherwise}\end{cases}$$

It should be noted that the ratio $$\frac{E_{smth}(n)}{e_{smth}(n)}$$

and the normalized decision weight, W(n), are functions of the maximum-to-minimum ratio $$\frac{E_{max}(n)}{N_{min}(n)}$$

which is a measure of the actual signal-to-noise ratio of the input signal S1.

The decision making logic 140 shown in FIG. 1 produces as an output signal the signal S9 indicated in FIG. 1. The signal S9 has for each frame a value of '1' or '0' according to whether the block 140 has decided that the frame contains active signal indicating speech or noise.

The clicks elimination block 150 shown in FIG. 1 further processes the signal S9 to determine whether clicks are still present in any active signal segment of the signal S9 and to eliminate clicks so found. It is to be noted that the preliminary clicks elimination procedure applied by block 203 is empirical and not ideal. The further clicks elimination processing applied by block 150 complements that of block 203. As noted earlier, the clicks to be eliminated are rapidly changing non-speech fragments such as FM radio clicks. The clicks elimination block 150 detects such clicks by determining whether the duration of any active signal segment of the signal S9, which is apparently speech, is less than a predetermined number of frames. For example, the predetermined number of frames may be selected to be equivalent to a duration of 40 msec, e.g. four frames where one frame has a length of 10 msec. The block 150 may, in an example of operation, use the following decision rules to determine if an active signal segment has a duration of at least four frames (and is not therefore a click):

$$DCL(n)=\begin{cases}1, & \text{if } D(n-3)\,\&D(n-2)\,\&D(n-1)\,\&D(n)=1\\ 0, & \text{otherwise}\end{cases}$$

where DCL(n) is a decision of the block 150 having a value of 1 or 0 for a frame numbered n, D(n) is the value of the parameter D for the frame numbered n, as indicated by the signal S9, D(n−3), D(−2 and D(n−1) are the values of the parameter D for each of the three individual frames preceding the frame numbered n, as indicated by the signal S9, and & is the Boolean AND operation function. The decision (of whether the frame contains noise or speech) made by the block 150 for each frame n is indicated by the output signal S10 produced by the block 150. Thus, the block 150 operates a delay-based clicks elimination method based on the observation that the average duration of a click is less than a given threshold duration, typically about 40 msec, so an active signal segment which is shorter than the threshold duration can be taken to be a click and can be eliminated. Frames containing active signal segments detected by the block 150 to be clicks therefore have the value '0' in the output signal S10. Other frames have the same value as for the signal S9.

Weak active speech signals, which may have intermittent low active speech signal levels, can be mis-classified as noise. In order to reduce the probability of such mis-classification occurring, further processing of the signal S10 produced by the block 150 is performed by the blocks 160, 170 and 180 shown in FIG. 1.

The hangover processor block 160 investigates whether an indicated active signal segment is present for a continuous period of time, the 'hangover' period, e.g. a pre-determined number of frames following an initial frame at the start of each active signal segment. The block 160 therefore determines, when the value '1' appears in the signal S10 for a given frame after the value '0' has appeared for one or more immediately preceding frames, whether the value '1' remains for all of the frames of the hangover period. The number of frames employed in the hangover period may for example be in the inclusive range of from one to five frames. The hangover processing block 160 thereby confirms as speech an active signal segment indicating apparent speech and provides the first frame of the segment with the confirmed value of '1' if it is. Otherwise, the first frame is given the value of '0' indicating no speech. This processing provides the benefit of avoiding drops or holes in speech transmission owing to the elongation and possible overlapping of smoothed active periods and can also help to avoid the chopping of weaker endings of speech segments. The block 160 produces the output signal S11 which is a modified form of the signal S10 and includes indications of its decisions for the initial frames of active signal segments.

The holdover processor block 170 investigates whether a non-speech (noise) segment following the end of a detected active signal segment of the signal S10 is present for a continuous period of time, e.g. a pre-determined number of frames, the holdover period, following the initial frame after the end of each active signal segment. The block 170 therefore determines, when the value '0' first appears in the signal S10 for a given frame after the value '1' has appeared for one or more immediately preceding frames, whether or not the value '0' remains after the initial frame for all of the subsequent frames of a holdover period. The number of frames employed in the holdover period may for example be in the inclusive range of from two to thirty frames. The holdover processor block 170 thereby confirms that each initial frame of an apparent non-speech segment following an active signal segment is correctly not in a segment of speech. The block 170 produces the output signal S12 which is a modified form of the signal S10 and includes indications of its decisions for the initial frames of non-active signal segments following active signal segments.

Operation of the hangover processor block 160 and of the holdover processor block 170 are illustratively shown in FIG. 1, and have been illustratively described, as parallel operations. These operations could however be combined together in a single functional block. Alternatively, other smoothing operations known in the art to eliminate mis-detection of speech segment starts or endings may be employed.

In some circumstances, e.g. under high traffic loads in a communication system, it may be desirable to reduce processing delays applied in certain blocks of the VAD 100, e.g. in the hangover and holdover periods employed in the blocks 160 and 170. For example, it may be desirable to reduce processing delays in order to save transmission bandwidth with only a slight potential degradation in quality of a transmitted or received speech signal. In other circumstances it may be desirable to increase the processing delays to obtain better VAD decisions and to achieve potentially greater voice quality in a speech signal. The processing delays applied in the VAD 100, e.g. the length of the hangover period employed by the block 160 or the length of the holdover period employed by the block 170 or both, may be adapted dynamically, e.g. according to monitored operational conditions in a system, e.g. a communication system, in which the VAD 100 is employed.

The output decision block 170 combines the signals S11 and S12 and accordingly produces as an output the signal S13 which includes for each analyzed frame of the input signal S1 an indication of whether the VAD 100 has determined the frame to be a speech frame or a non-speech frame. The indication for each frame may be provided in the signal S13 digitally, e.g. in the form of the value '1' for a speech determination and the value '0' for a non-speech determination.

The output signal S13 produced by the output decision block 180 is the main output signal produced by the VAD 100 and may employed in any of the ways known in the art in which VAD output signals are known to be used. For example, the VAD 100 may be employed in a packet transmission system in which a speech signal is converted into packet data. In this case, the output signal S13 may be supplied to compression logic and/or to noise elimination logic of the packet transmission system in combination with a control signal for the application of compression and/or noise elimination as required by the packet transmission system. The segments (frames) of the output signal S13 indicated not to be speech can be eliminated and the active segments (frames) indicated to be speech may be compressed and/or passed for transmission as desired, all in a known way.

In the VAD 100, various operating parameters which have been described may be adjusted by design to suit the input signal S1 to be processed, the equipment used in the implementation of the VAD 100 and any output system in which the output signal S13 is to be used, e.g. a communication system such as a packet data transmitter. A tradeoff may be selected between operational parameters employed in the system. For example, a tradeoff may be selected between the extent of compression employed and the degradation of a transmitted active signal likely to be experienced. Any of the operational parameters employed in the VAD 100, e.g. sub-frame length, frame length, sampling rate, periods between adaptive parameter updating, hangover and holdover periods, as well as the algorithms employed to provide functional operations in the various functional blocks of the VAD 100, can be selected to obtain suitable implementation results. Operation of the VAD 100 and any system in which it is employed can be monitored. Any one or more of the operational parameters and/or algorithms employed in the VAD 100 can be adapted or adjusted to achieve desired results.

In the foregoing description, specific embodiments have been described. However, one of ordinary skill in the art will appreciate that various modifications and changes can be made to the described embodiments without departing from the scope of the invention as set forth in the claims below. Accordingly, the description and drawings are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced, as included in the foregoing description, are not to be construed as critical, required, or essential features or elements of any or all the claims unless specifically recited in the claims. The invention is defined solely by the appended claims including any amendments made during the pendency of this application and all equivalents of those claims in the patent as granted or issued.

The invention claimed is:

1. A voice activity detector for detecting the presence of speech segments in frames of an input signal, comprising:

a programmed microprocessor configured to implement:

a frame divider for dividing frames of the input signal into consecutive sub-frames;

an energy level estimator for estimating energy levels of the input signal in each of the consecutive sub-frames;

a noise eliminator for analyzing the estimated energy levels of sets of the sub-frames to detect and to eliminate from energy level enhancement noise sub-frames and to indicate remaining sub-frames as speech sub-frames for energy level enhancement, an energy level enhancer for enhancing respective energy levels estimated by the energy level estimator for each of the indicated speech sub-frames by an amount which relates to a detected change of the estimated energy level for a current indicated speech sub-frame relative to that for neighbouring indicated speech sub-frames;

a frame maximum energy level estimator for estimating for each frame a maximum energy value of the respective energy levels for the sub-frames of each frame;

a frame maximum enhanced energy level estimator for estimating for each frame a maximum enhanced energy level value of the respective enhanced energy levels determined by the energy level enhancer for the indicated speech sub-frames of each frame; and decision logic for receiving (i) a first signal indicating for each frame a discriminating factor value, (ii) a second signal indicating for each frame the maximum energy value, and (iii) a third signal indicating for each frame the maximum enhanced energy level value, and deciding whether or not each frame is speech or noise as a function of the first, second, and third signals and to produce an output signal indicating the decision for each frame.

2. The voice activity detector according to claim 1, the programmed microprocessor further configured to implement an energy level change analyzer for analyzing the indicated speech sub-frames and determine for each indicated speech sub-frame a local envelope of the estimated energy level by detecting changes in the energy level between each particular one of the indicated speech sub-frames and its respective neighbouring indicated speech sub-frames.

3. The voice activity detector according claim 1, the programmed microprocessor further configured to implement:

a frame minimum energy level estimator for estimating for each frame of the received signal a minimum energy level value of the energy levels of sub-frames of the frame, and a maximum-to-minimum ratio calculator for calculating for each frame a normalized ratio R(n) of the maximum enhanced energy level value to the minimum energy level value.

4. The voice activity detector according to claim 3, the programmed microprocessor further configured to implement:

an adaptive threshold producer for calculating for each frame an adaptive threshold as a function of the minimum energy level value and the maximum enhanced energy level value; and a discriminating factor calculator for providing the discrimination factor value by subtracting for each frame the adaptive threshold from the normalized ratio.

5. The voice activity detector according to claim 4, the programmed microprocessor further configured to implement a discriminating factor transformer for transforming the discriminating factor value calculated by the discriminating factor calculator for each frame to a fixed value whenever the calculated value reaches or exceeds a limiting threshold value.

6. The voice activity detector according to claim 5, the programmed microprocessor further configured to implement a discriminating factor smoother for smoothing the transformed discriminating factor value by calculating an average of values of the transformed discriminating factor over several consecutive frames including a current frame and providing the smoothed value as the discriminating factor value for the current frame.

7. The voice activity detector according to claim 6, the programmed microprocessor further configured to implement at least one smoother for smoothing at least one of the second and third signals received at the decision logic so that the at least one of the second and third signals for each current frame is an average value taken over multiple consecutive frames.

8. The voice activity detector according to claim 3, wherein the maximum-to-minimum ratio calculator calculates for each frame a value of the normalized maximum-to-minimum ratio R(n) which is equal to K times 1/(1+r), where K is a constant, and r is a ratio of the frame minimum energy level value to the frame maximum enhanced energy level value.

9. The voice activity detector according claim 1, the programmed microprocessor further configured to implement a clicks eliminator for detecting frames containing noise clicks in the received signal and for eliminating such frames.

10. The voice activity detector according to claim 1, wherein the noise eliminator detects sub-frames containing noise clicks by detecting rapid changes in energy level values between adjacent sub-frames and to eliminate such sub-frames containing noise clicks from enhancement by the energy level enhancer.

11. The voice activity detector according to claim 1, wherein the noise eliminator detects sub-frames containing periodic electrical noise and to eliminate such sub-frames from enhancement by the energy level enhancer.

12. A method of operation in a voice activity detector, the method comprising:

dividing frames of an input signal to the voice activity detector into consecutive sub-frames;

estimating energy levels of the input signal in each of the consecutive sub-frames;

analyzing the estimated energy levels of sets of the sub-frames and detecting and eliminating from further enhancement noise sub-frames, and indicating remaining sub-frames as speech sub-frames;

enhancing respective estimated energy levels for each of the indicated speech sub-frames by an amount that relates to a detected change of the estimated energy level for a current indicated speech sub-frame relative to that for neighboring indicated speech sub-frames;

estimating for each frame a maximum energy value of the respective energy levels for the sub-frames of each frame;

estimating for each frame a maximum enhanced energy level value of the respective enhanced energy levels for the indicated speech sub-frames of each frame; and deciding whether or not each frame is speech or noise as a function of first, second, and third signals and producing an output signal indicating the decision for each frame, the first signal indicating a discriminating factor value for each frame, the second signal indicating the maximum energy value for each frame, and the third signal indicating the maximum enhanced energy level value for each frame.

13. The method according to claim 12, further comprising analyzing the indicated speech sub-frames of the input signal to determine for each indicated speech sub-frame a local envelope of the estimated energy level by detecting changes in the energy level between each particular one of the indicated speech sub-frames and its respective neighboring speech sub-frames.

14. The method according to claim 12, further comprising for each frame:

estimating a minimum energy level value of the energy levels for sub-frames of the frame, and calculating a normalized ratio R(n) of the maximum enhanced energy level value to the minimum energy level value.

15. The method according to claim 14, further comprising for each frame:

calculating an adaptive threshold as a function of the minimum energy level value and the maximum enhanced energy level value; and subtracting the adaptive threshold from the normalized ratio to provide the discriminating factor value for the frame.

16. The method according to claim 15, further comprising transforming the discriminating factor value for each frame to a fixed value whenever the calculated value reaches or exceeds a limiting threshold value.

17. The method according to claim 16, further comprising smoothing the transformed discriminating factor value by calculating an average of values of the transformed discriminating factor value over several consecutive frames including a current frame and providing the smoothed value as the discriminating factor value for the current frame.

18. The method according to claim 17, further comprising smoothing at least one of the second and third signals so that the at least one of the second and third signals for each current frame is an average value taken over multiple consecutive frames.

19. The method according claim 17, further comprising detecting frames containing noise clicks and eliminating such frames.

* * * * *